US008555559B2

(12) United States Patent
DiGregory

(10) Patent No.: US 8,555,559 B2
(45) Date of Patent: Oct. 15, 2013

(54) FOLDABLE TRANSPORTABLE STRUCTURE

(76) Inventor: Vincent J. DiGregory, Albuquerque, NM (US)

( * ) Notice: Subject to any disclaimer, the term of this patent is extended or adjusted under 35 U.S.C. 154(b) by 0 days.

(21) Appl. No.: 13/068,430

(22) Filed: May 11, 2011

(65) Prior Publication Data

US 2012/0285104 A1 Nov. 15, 2012

(51) Int. Cl.
*E04H 1/00* (2006.01)

(52) U.S. Cl.
USPC ..... 52/79.5; 52/71

(58) Field of Classification Search
USPC ..... 52/79.5, 71, 66; 135/137
See application file for complete search history.

(56) References Cited

U.S. PATENT DOCUMENTS

| | | | | |
|---|---|---|---|---|
| 1,561,797 | A * | 11/1925 | Rumpel | 5/216 |
| 1,621,464 | A * | 3/1927 | Fortin | 5/113 |
| 3,118,186 | A * | 1/1964 | Moss | 52/71 |
| 3,386,209 | A | 6/1968 | Starcevic | |
| 3,420,003 | A | 1/1969 | Cline | |
| 3,905,548 | A | 9/1975 | Brodie | |
| 3,906,671 | A | 9/1975 | Maldonado | |
| 4,070,802 | A | 1/1978 | Odom | |
| 4,166,343 | A | 9/1979 | O'Brian | |
| 4,395,855 | A | 8/1983 | Juker | |
| 4,696,132 | A | 9/1987 | LeBlanc | |
| 4,779,514 | A | 10/1988 | Prigmore et al. | |
| 5,448,799 | A | 9/1995 | Stein, Jr. | |
| 5,493,818 | A | 2/1996 | Wilson | |
| 5,966,956 | A | 10/1999 | Morris et al. | |
| 6,192,909 | B1 * | 2/2001 | Strausser | 135/137 |
| 6,983,567 | B2 | 1/2006 | Ciotti | |
| 7,533,942 | B2 * | 5/2009 | Kennedy et al. | 299/12 |
| 2002/0083654 | A1 * | 7/2002 | Bini | 52/66 |
| 2003/0140573 | A1 | 7/2003 | Marcinkowski et al. | |
| 2005/0011139 | A1 * | 1/2005 | Sample | 52/36.1 |
| 2009/0107020 | A1 | 4/2009 | Aires | |

* cited by examiner

*Primary Examiner* — Basil Katcheves

(57) ABSTRACT

Disclosed is a foldable transportable structure with a three dimensional rectangular shed roof shape having improved component and structural properties, and improved shipping and deployment capabilities. The integrated unique geometric folding pattern means provides enhanced folding accuracy and correct placement of interactive panels during collapse or assembly of the structure, and also greatly increases the flexibility for multiple unit combinations and component materials selection. The folding transportable structure provides a strong, safe, insulated weatherproof structure with a quick setup time, and requires NO tools or separate loose components for assembly.

19 Claims, 6 Drawing Sheets

FOLDABLE TRANSPORTABLE STRUCTURE

BACKGROUND OF THE INVENTION

1. Field of the Invention

The present invention relates to a foldable transportable structure that when deployed provides a truly collapsible, transportable, insulated and lightweight structure that is safe, reliable and internationally compliant. Its designed flexibility provides maximum convenience for the following: quick deployment to nearly any geographic location; use of varying component materials and sizes; and interconnectability of single units for multiple unit combinations. The ability of the structure to be air-dropped also allows service to the most remote locations where shelter or facility use is needed.

2. Description of the Prior Art

Typically, supplied conventional structures offer only one or a few of a complete set of required properties that include: an easily erectable configuration for fast field installation; a requirement of NO tools or separate parts and pieces for assembly; a capability for remote deployment; a specific insulation value if needed; structural integrity; long-term durability; a design that allows for flexible use of materials choice and the potential to combine together multiple units.

U.S. Pat. No. 5,493,818 describes a "collapsible" structure having improved storage and shipping properties which are achieved by specific designing of the size, shape and hingeable connection positions whereas said structure is erectable and collapsible within minutes utilizing a minimal amount of tools and effort.

Geometric and dimensional limitations will not allow this structure to physically collapse into a stackable configuration as claimed. The roof panels will not be able to completely stretch out to lay flat when the roof panels are of a long enough dimension to form a gabled configuration, as their combined length when laying flat is much longer than the available length that the wall panels provide when they are in their folded flat configuration. An attempt to collapse the roof panels into a fully folded flat position will cause the wall panels below to hinge-bind dramatically resulting in neither of the roof or wall panels being able to lay completely flat. Alternately, when the wall panels are in a completely folded flat position the gable roof panels will not be allowed to fully stretch out and lay flat. In summary, the designed geometry will not allow full complete collapse of the stacked panels. All Sections and Claims within U.S. Pat. No. 5,493,818 refer to the invention as being a fully collapsible structure, which it will not be able to accomplish. This may be why it has not been adopted for large scale use.

U.S. Pat. No. 4,779,514 describes a "modular portable building unit" susceptible to air transport, and includes a roof, foldable side walls and foldable end walls having the same width as the height of the side walls. Three of the modular building units can be interfitted (sic) to form a building having four times as much floor space as the single modular building unit. The inclusion of a floor in the modular building is optional, and the inclusion of a separate pitched roof assembly for positive roof drainage is optional. Additional object of the invention is to provide a modular building unit that when folded down will allow transport by air or truck, and to allow combinations of multiple units together.

This method is limited by the gable end panels being separate components, and the separate fastening components and systems required to erect and/or collapse the unit. Redeployment and transport of this structure can be accomplished only after a very time consuming and tedious removal of many parts and pieces has been done. The lack of provisions for a passage opening, door, or other means shown for ingress or egress between the connected units is detrimental to the function and internal occupant flow of the connected units. Therefore no added value to the user from connecting the units together is recognized, and this may be why this system has not been adopted for large scale use.

U.S. Pat. No. 4,166,343 describes a hollow, generally rectilinear structure having a top, a bottom, sides and ends that can be constructed so as to be capable of being manipulated between a "normal" or unfolded type configuration and a collapsed or folded configuration in which the ends extend generally parallel to and beneath the top and in which the sides are folded so as to be located next to the ends generally between the bottom and the top. Such a structure includes hinges connecting the ends to the top so that they can be pivoted so as to lie generally parallel to the top. Such a structure is disclosed as having utility as a playhouse or storage shed but can be utilized for other purposes such as a container.

This structure is limited in that the gable end panels are separate panels that are hinged to the roof panel. The erection of the unit will not be manageable by the roof having to carry the added weight of the gable panels during erection of the side walls and roof panels at the same time. This will be completely unmanageable in the field. The structure also does not have means for combination of multiple units, or optional door placement locations, or a window to provide ventilation. This may be why this structure has not been adopted for field use, and is not a presently being manufactured.

U.S. Pat. No. 3,906,671 describes an adjustable door frame having frame portions formed by first and second frame sections cooperatively arrangeable (sic) on a wall of an opening.

This method provides adjustability only to the door frame for installation to variable wall thicknesses, and can only provide one of four possible door swing functions or configurations when installed. The mitered head jamb and casing pieces directly attach to the mitered hinge and strike jambs. This static configuration does not allow for the potential inversion of the hinge and strike jambs that would be required so that the entire door and frame assembly could be installed in either a right or left hand, or inside or outside, door swing configuration. In order for a door frame assembly to be completely and fully adjustable both of the hinge and strike jamb components must have the ability to be inverted and attachable to either the head or sill components so that the entire frame and door assembly can be installed in any of the 4 each possible swing configurations. This may be why this invention has not been adapted for field structures use.

U.S. Pat. No. 4,395,855 describes a pre-fabricated door frame assembly, the components which are adjustable and such that the assembly can be used for either right or left handed doors and can fit a wide variety of widths and heights of door openings through walls of varying thicknesses.

This method is designed to attach to standard constructed building walls that are normally much wider than the thinner wall panels typically used for flat-pack shelter units, and requires separate fasteners and tools for attachment to the wall system. This invention also does not include an integrated threshold or weather strip component for exterior wall use, which would be necessary for shelter units that would be deployed in hot or cold climates. This invention has limited use in that is does not offer diversity and the flexibility to be used in both interior and/or exterior applications, and it is not easily reversible or re-installable in the field without the use of tools or separate fasteners that may or may not be available.

U.S. Pat. No. 3,420,003 describes an adjustable door frame that adjusts to varying wall thicknesses, and can be installed quickly and easily with screws that go directly into the wall system. It consists of several longitudinal trim and jamb components that overlap and stay in place by ratchet teeth and backing plates that when the installation screw component is installed the separate pieces become locked into place.

This method is designed to attach to standard constructed building walls, and requires separate fasteners and tools for attachment to the wall system. This invention also does not include an integrated threshold or weather strip component for exterior wall use, which would be necessary for shelter units that would be deployed in hot or cold climates. This invention has limited use in that is does not offer diversity and the flexibility to be used in both interior and/or exterior applications, and it is not easily reversible or re-installable in the field without the use of tools or separate fasteners that may or may not be available.

U.S. Pat. No. 5,448,799 describes a hinge assembly for pivotally adjoining two panels together such as a shower door and its enclosure. A pair of continuous channel members are provided which are provided with an axial aligned rod and tubular channel for rotatably (sic) receiving the rod.

This method includes a weather strip component that protrudes beyond the profile of the wall panel extrusions. This component could not be utilized in a foldable structure as the protrusion will not allow adjacent and connected together wall panels to lay flat against each other when the structure is in a collapsed position.

SUMMARY OF THE INVENTION

The present invention is a folding transportable shelter with improved properties of: accurate folding hinge geometry, advanced interactive and integrated components that are designed to allow for either transportable or assembled structure configurations; advanced component materials for increased insulation; structural integrity; long-term dependability; built-in flexibility for optional placements of doors, windows or clear openings; and built-in flexibility for choice and use of varying materials and sizes for integrated components.

It is therefore a primary objective of the present invention to provide a foldable transportable structure that will significantly enhance the quality, functionality, stackable transportability, flexibility and affordability of moveable shelter structures.

It is another object of the present invention to include in the design a sophisticated geometric folding pattern means that significantly improves the allowance for integration and use of varying component materials, and also significantly improves the interactive complimentary relationships of folding accuracy, necessary clearances, and continual structural contact between adjacent components during the collapse and assembly functions of the unit.

It is another object of the present invention to include in the design same said sophisticated geometric folding pattern means that remains static, while allowing complete flexibility for: choice of overall structure size; use of any chosen dimension for panel thicknesses and relative connector widths; ability to combine together floor, wall and roof panels that are comprised of different individual thicknesses to obtain varying insulation values; without any of the above impacting the folding and assembly accuracy, or overall capabilities of the structure.

It is a further object of the present invention to provide specific designed continuous pivot hinge-to-panel connectors, an adjustable door assembly, a leveling foot assembly, a strap conveyance and tie-down assembly, and a flexible fillable bladder bag component to further improve the function, flexibility and use of the structure.

It is a further object of the present invention to provide a foldable transportable structure that has flexible integral components that are interchangeable during the manufacturing process for making structures that provide specific solutions for use in variable field conditions that include climatic, structural, deployment and usage considerations.

It is still another object of the present invention to provide a foldable transportable structure that contains the flexibility to be interconnected with additional like units of varying wall thicknesses to make larger structures, and includes removable wall panel sections for in-the-field-flexibility to interchange doors, windows or clear openings to create various configurations for maximum internal occupant flow and use.

These, and other objects of the present invention, will become apparent to those skilled in the art upon reading the accompanying description, drawings, and claims set forth herein.

DETAILED DESCRIPTION OF THE INVENTION

Figure 1:
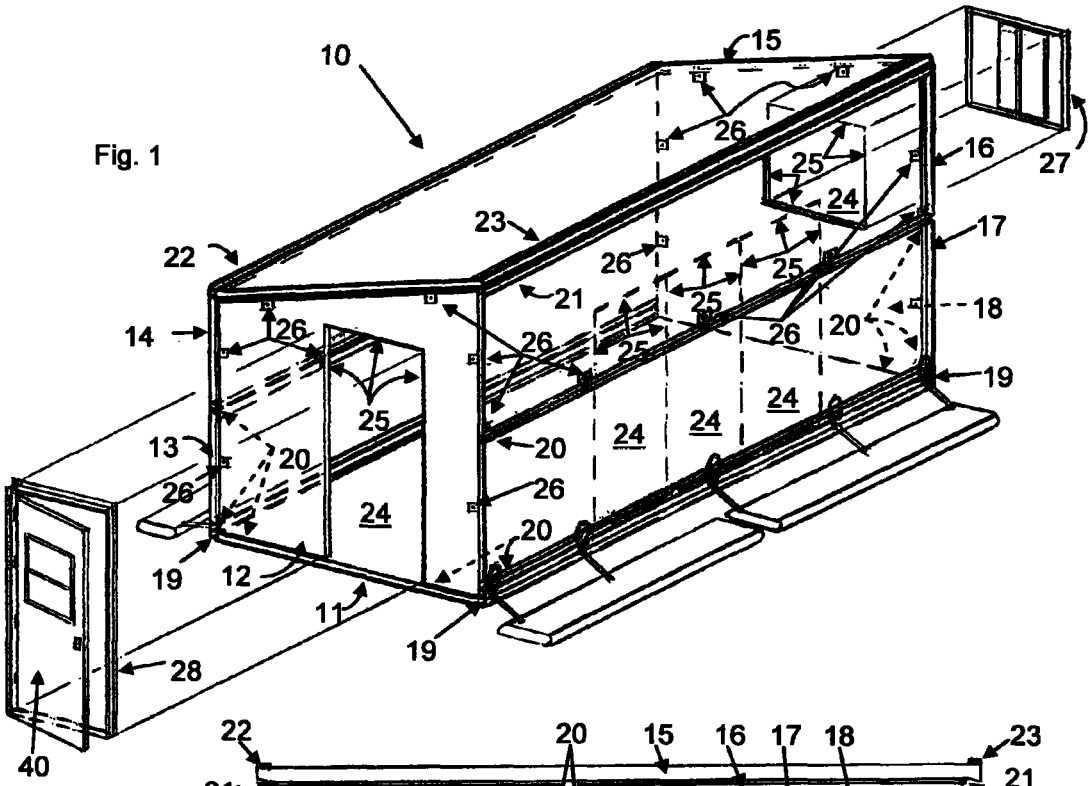
FIG. 1 is a perspective view of the erected foldable transportable structure according to the present invention.
Figure 17:
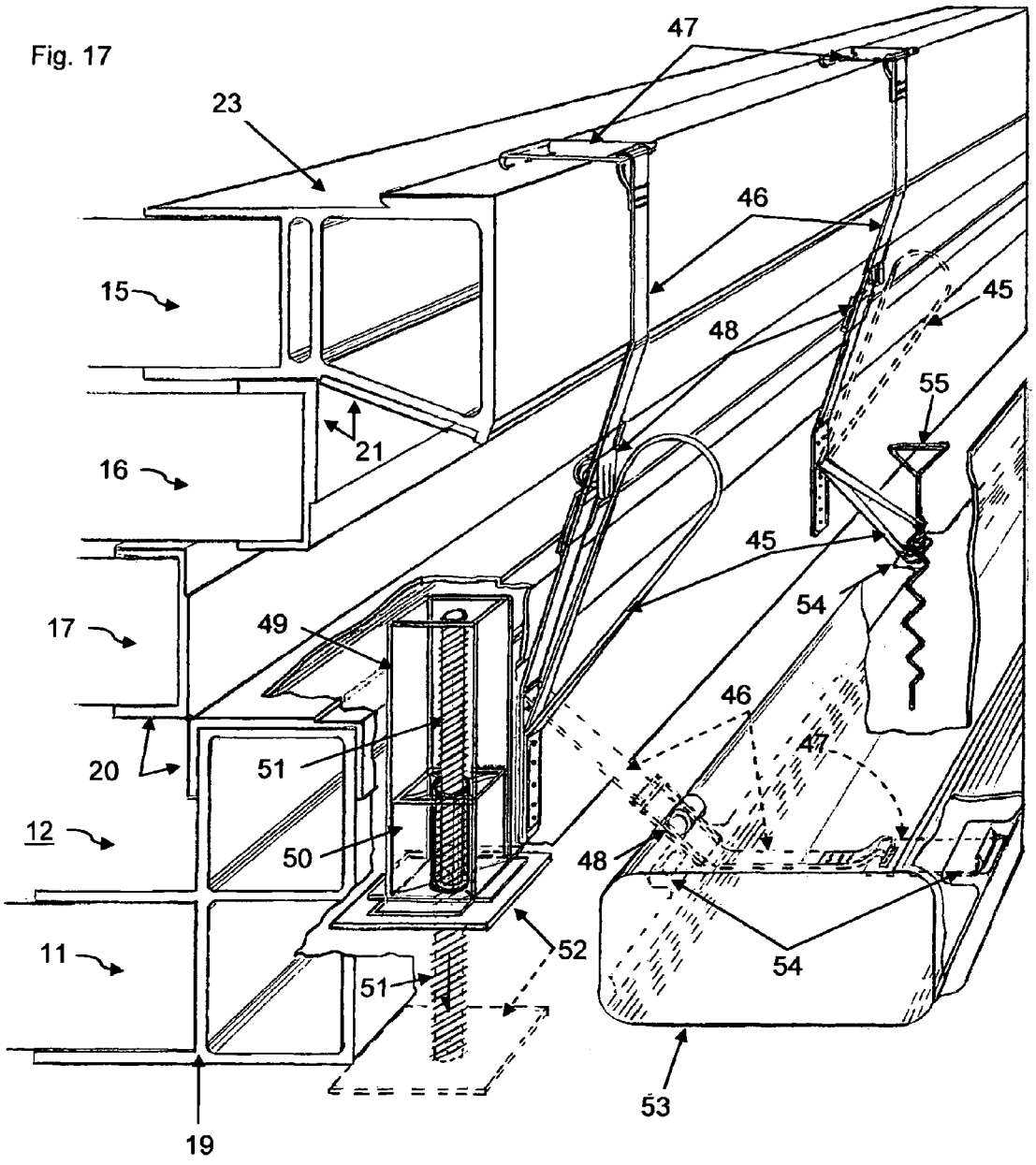
FIG. 17 is a perspective cut-away view of the collapsed structure showing the adjustable strap conveyance and tie-down assembly, the adjustable leveling foot assembly, the spiral ground stake component, and the fillable bladder bag component according to the present invention.

FIG. 1 shows a perspective view of the best mode contemplated by the inventor of the erected foldable transportable structure 10 according to the concepts of the present invention. As seen by the drawings the foldable transportable structure 10 consist of a series of structural panels and continuous pivot hinge components connected together in a way that allows for either a folding up of the structure into a fully erected configuration as seen in FIG. 1, or a folding down of the structure into a flat fully collapsed configuration for transportable methods as seen in FIG. 2 and FIG. 17.

Figure 4:
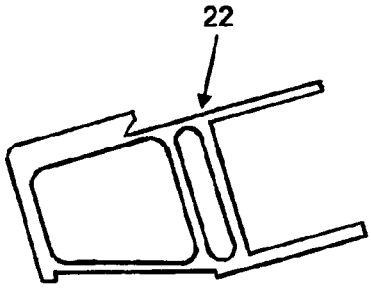
FIG. 4 is a detail cross sectional view of the roof eave-to-wall connector component according to the present invention.
Figure 5:
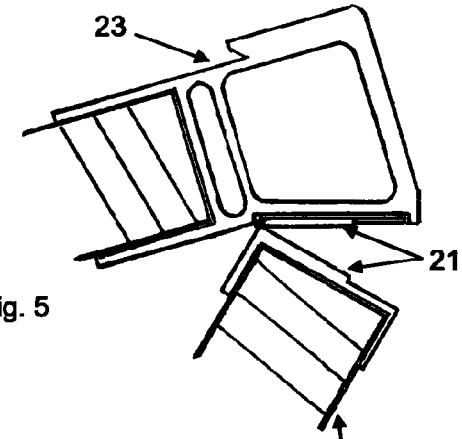
FIG. 5 is a detail cross sectional view of the roof ridge-to-wall connector component, and connection to the separate adjacent continuous pivot hinge wall-to-roof connector component (as shown in FIG. 6), and the related hinging motion according to the present invention.
Figure 6:
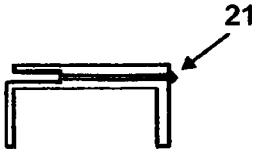
FIG. 6 is a detail cross sectional view of the continuous pivot hinge wall-to-roof connector component according to the present invention.
Figure 7:
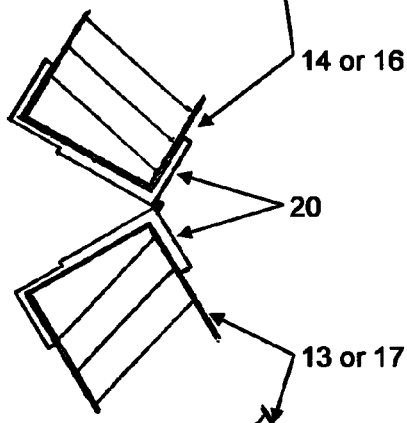
FIG. 7 is a detail cross sectional view of the continuous pivot hinge wall-to-wall connector component (as shown in FIG. 8), and connection between adjacent lower and upper wall panels, and the related hinging motion according to the present invention.
Figure 8:
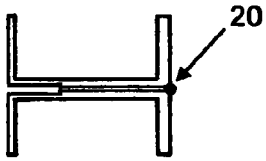
FIG. 8 is a cross sectional view of the continuous pivot hinge wall-to-wall connector component according to the present invention.
Figure 9:
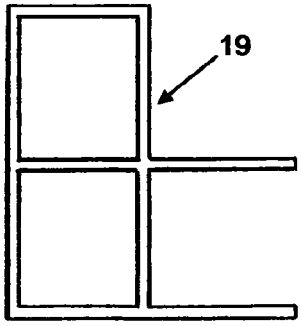
FIG. 9 is a detail cross sectional view of the floor-to-curb panel connector component according to the present invention.
Figure 10:
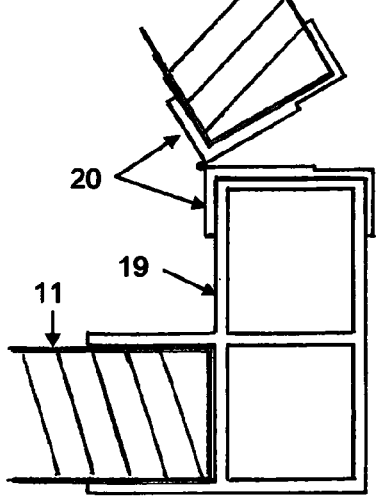
FIG. 10 is a detail cross sectional view of the floor-to-curb panel connector component, and connection to the floor panel and adjacent lower wall panel, and the related hinging motion according to the present invention.

The foldable transportable structure 10 consists of a single floor panel 11 of which each of its long axis edges are connected to a floor-to-curb panel connector 19, as seen in FIG. 9 and FIG. 10. A continuous pivot hinge wall-to-wall connector 20 is attached between one of the floor-to-curb panel connectors 19 and the short side wall panel 13 as seen in FIG. 10. A continuous pivot hinge wall-to-wall connector 20 is attached between the remaining floor-to-curb panel connector 19 and the tall side wall panel 17 as seen in FIG. 10. A continuous hinge wall-to-wall connector 20 is attached between the short side wall panels 13 and 14 as seen in FIG. 7. A continuous hinge wall-to-wall connector 20 is attached between the tall side wall panels 16 and 17 as seen in FIG. 7. A continuous hinge wall-to-roof connector 21 is connected between the short side wall panel 14 as seen in FIG. 5, and the roof eave-to-wall component 22 as seen in FIG. 4. A continuous hinge wall-to-roof connector 21 is connected between the tall side wall panel 16 and the roof ridge-to-wall component 23 as seen in FIG. 5. The single roof panel 15 is connected between the roof eave-to-wall connector 21 and the roof ridge-to-wall connector 23 as seen in FIG. 1, FIG. 4, and FIG. 5. A continuous pivot hinge wall-to-wall connector 20 as seen in FIG. 8 is connected between the bottom of each of the gable end wall panels 12 and 18 and the floor panel 11 as seen in FIG. 1. The exposed ends of the wall panels 13, 14, 16 and 17, and the exposed edges of the roof panel 15 are capped off with a trim piece that includes a weather strip lip to provide a sealed positive stop for each of the gable panels 12 and 18 when erected.

Figure 2:
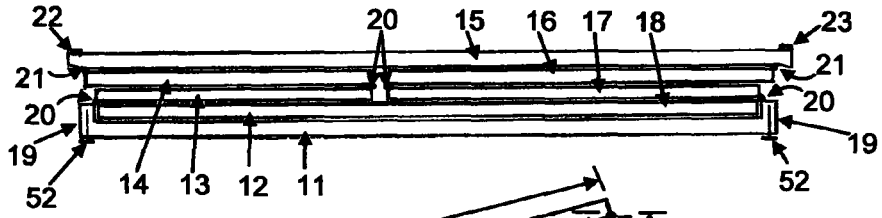
FIG. 2 is a cross sectional view of the collapsed foldable transportable structure according to the present invention.
Figure 18:
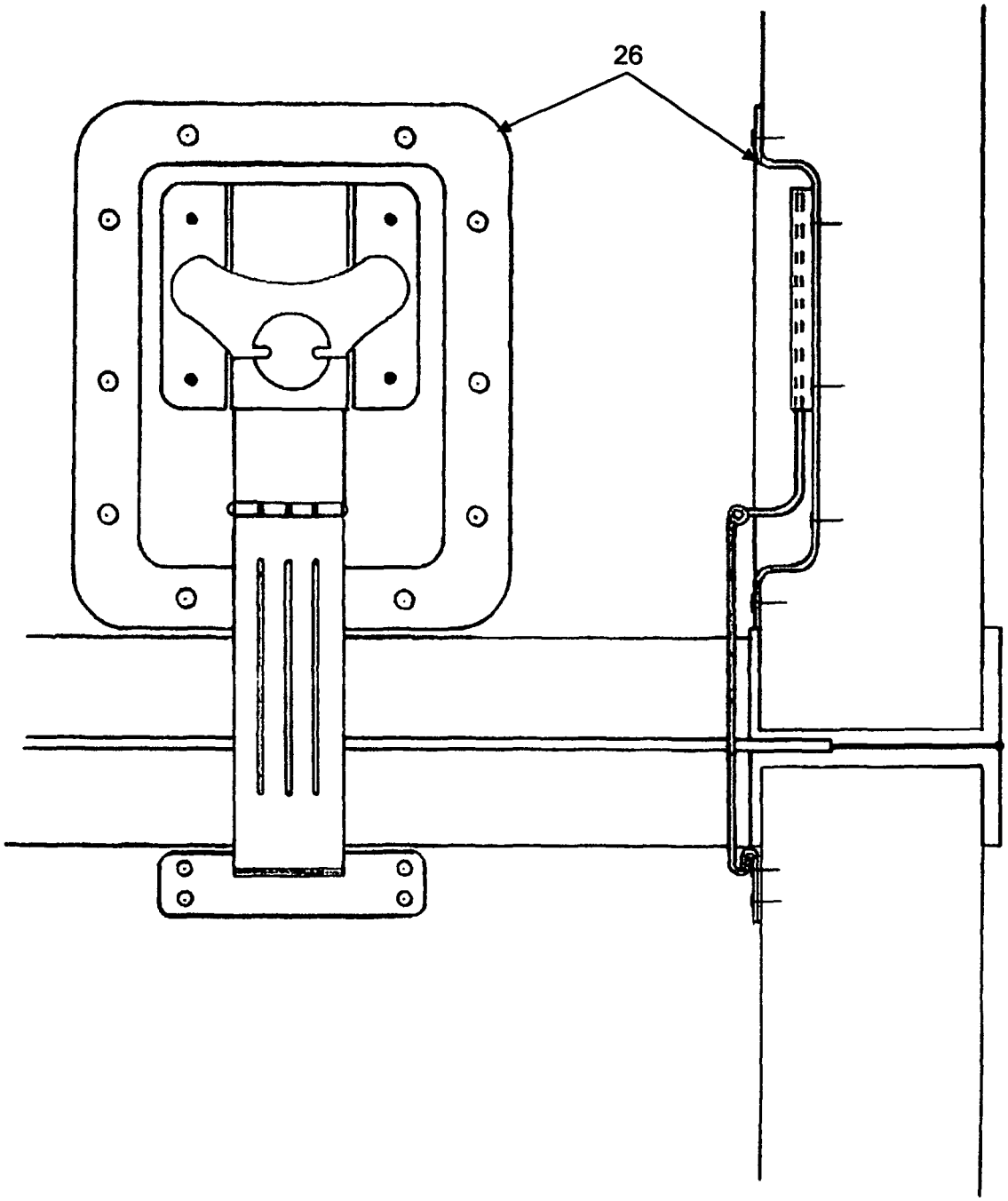
FIG. 18 is a section and elevation view of the valance draw latch.

FIG. 2 shows a cross section of the collapsed structure in its folded flat transportable configuration. For further reference FIG. 17 also shows a more detailed view of the individual panels when they are arranged in the folded flat configuration. When the structure 10 is in its fully erected configuration each individual wall panel is secured to its adjacent panel by a series of structural recessed draw latches 26, as seen in FIG. 1 and FIG. 18, that are located on the interior of the structure and must be disengaged in order to allow each individual wall panel to be folded down. To collapse the structure the following procedure is followed: gable end wall panels 12 and 18 are folded inward to lay flat on top of the single floor panel 11; the short side walls 13 and 14 are folded inward to lay flat on top of the gabled wall panels 12 and 18; the tall side walls 16 and 17 are folded inward to lay flat on top of the gabled wall panels 12 and 18; the single roof panel 15 follows the folding path of each side wall 14 and 16, as each are folded down into their relative position, to then lay flat on top of walls 14 and 16. To secure the panels together in the folded flat configuration for transportation a series of adjustable strap tie-down assemblies made up of components 46, 47 and 48 are attached to the roof eave-to-wall connector 22, and roof ridge-to-wall connector 23 as seen in FIG. 17. To erect the structure simply reverse the process as described above.

Figure 3:
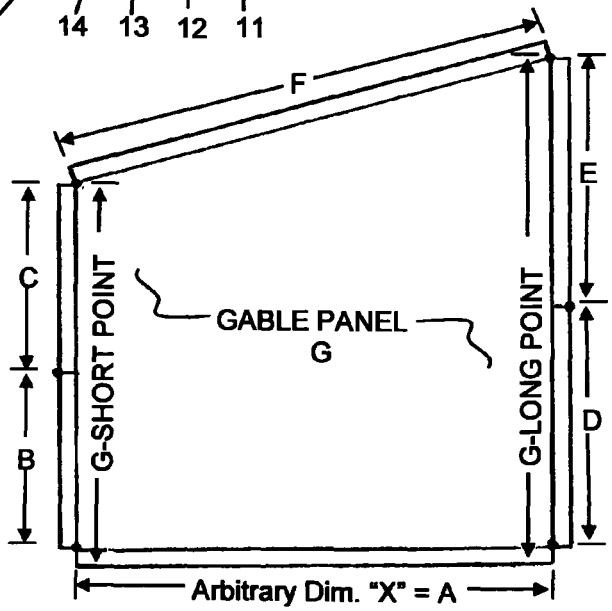
FIG. 3 is a cross sectional view of the geometric folding pattern included in the foldable transportable structure according to the present invention.

FIG. 3 shows the vertical layout for the geometric folding pattern that formulates the static hinge-to-hinge centering relationships between the structure's individual panels, and establishes a guide for the finished panel widths or height dimensions for the floor panel 11, the wall panels 13, 14, 16 and 17, the roof panel 15, the gabled wall panels 12 and 18, and the vertical short and long points for the gabled wall panels 12 and 18. The relative dimensions are defined using the following pattern formulation: a floor panel expressed as 'A' with an arbitrarily chosen width dimension being designated as 'X'; a bottom short wall panel expressed as 'B' being of a height that is relative to 41.27617% of 'X'; an upper short wall panel expressed as 'C' being of a height that is relative to 43.27018% of 'X'; a bottom tall wall panel expressed as 'D' being of a height that is relative to 55.63310% of 'X'; an upper tall wall panel expressed as 'E' being of a height that is relative to 57.76271% of 'X'; a roof panel expressed as 'F' that is of a width that is relative to 103.98803% of 'X'; a pair of gable panels expressed as 'G' that are of a width that is relative to 99.70089% of 'X'; a pair of gable panels expressed as 'G' with a short point height that is of a length that is relative to 84.24725% of 'X' plus the chosen thickness width of the wall panels; a pair of gable panels expressed as 'G' with a long point height that is of a length that is relative to 112.96111% of 'X' plus the chosen thickness width of the wall panels.

Figure 11:
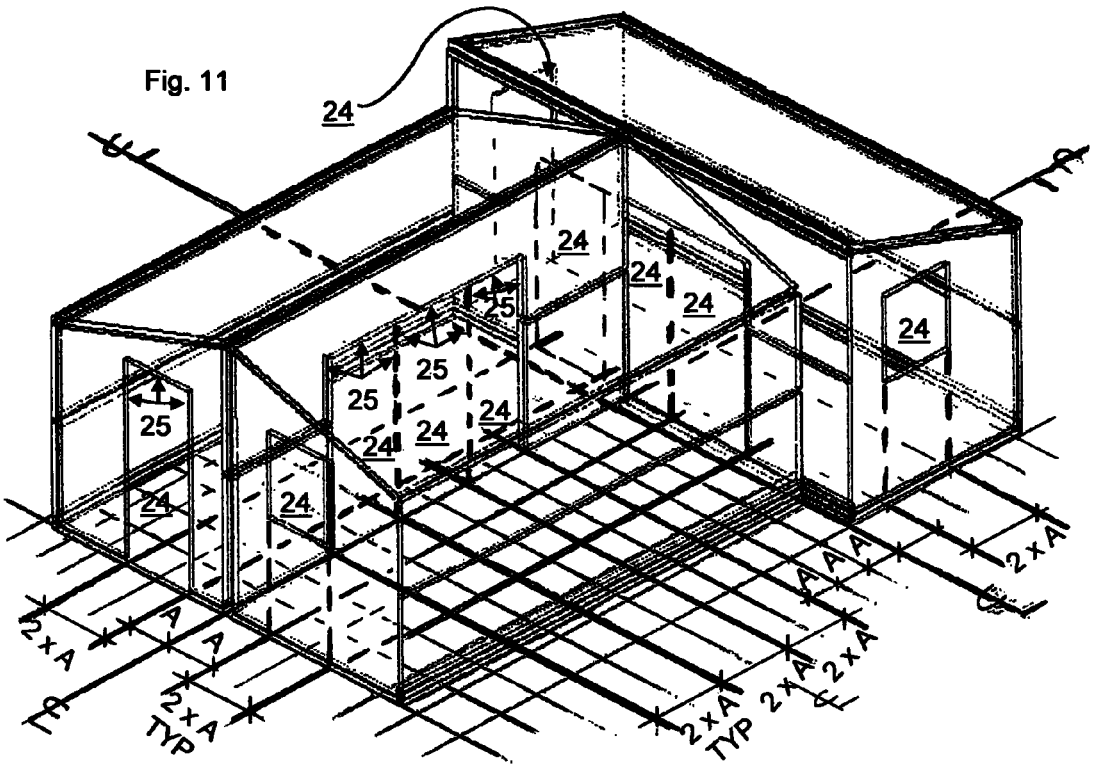
FIG. 11 is perspective view showing the architectural horizontal grid pattern that provides specific layout locations for removable and interchangeable wall panels, door and window components according to the present invention.
Figure 12:
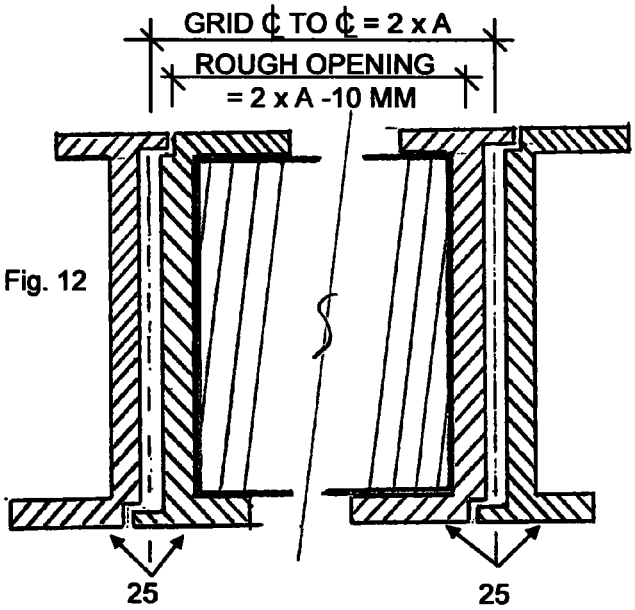
FIG. 12 is a detail cross sectional view of the removable wall panel interlocking edge trim component according to the present invention.
Figure 13:
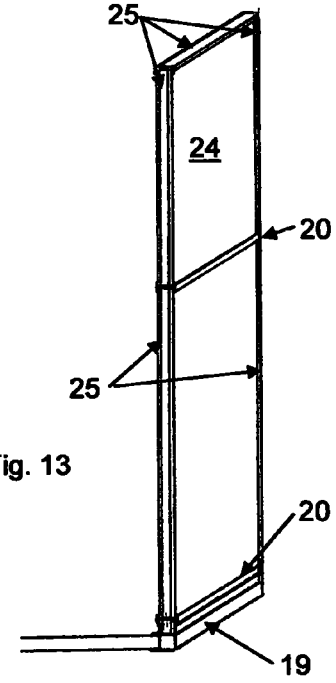
FIG. 13 is a perspective view showing a removable panel assembly according to the present invention.

FIG. 11 shows a perspective view of the grid layout system for the removable wall panel 24 locations to allow the creation of a door opening (as can also be seen in FIG. 1 Detail 28), or a window opening (as can also be seen in FIG. 1 Detail 27), or clear openings (as can also be seen in FIG. 1 Detail 24) in any one of variable locations within the tall or gable walls of the structure. The finished dimension width of the removable wall panel 24 and its respective rough opening is a result of two (2) times an Arbitrary Dimension expressed as 'A'. FIG. 12 shows a detail cross sectional view of the interlocking edge trim 25 that is installed around the perimeter of each of the removable wall panel 24 components as seen in FIG. 13. FIG. 13 shows a perspective elevation of the removable wall panel 24, and the locations of the interlocking edge trims 25 and the continuous pivot hinge wall-to-wall connector locations.

Figure 14:
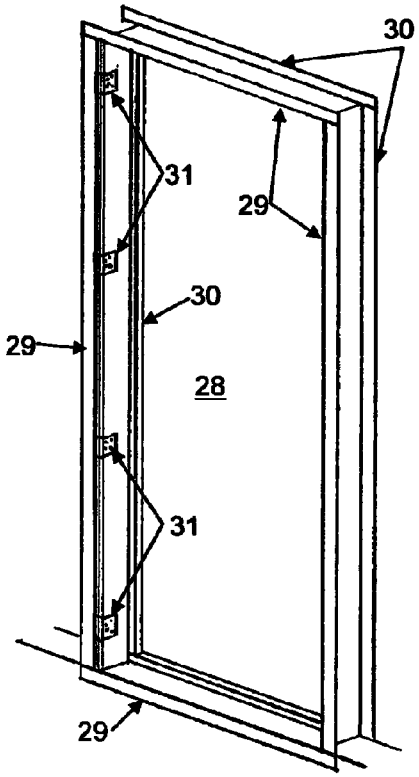
FIG. 14 is a perspective view of the reversible and invertible door frame assembly according to the present invention.

FIG. 14 is a perspective elevation view of the overall configured door frame assembly 28 which includes a series of separate adjustable interlocking jamb components 29 and 30, and a series of hinge components 31.

Figure 15:
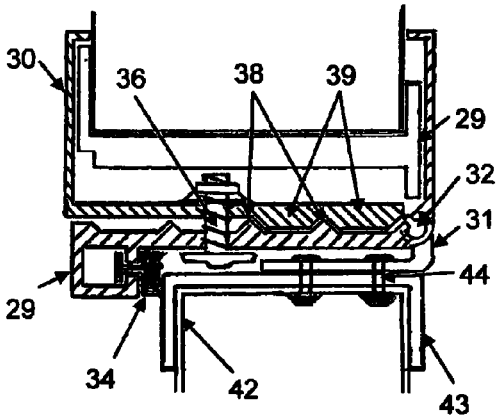
FIG. 15 is a detail cross sectional view of the FlexFrame door components according to the present invention.

FIG. 15 shows a detail cross section of the jamb components to include the following: an L' shaped jamb component 29 that is used for the side jambs, header and sill components; an L' shaped jamb component 30 that is used for the side jambs and header components only, and installs behind side jamb and header components 29; a thru-bolt and compression nut assembly 36 for securing jamb components 29 and 30 together; and a hinge component 31 for attachment of the door 42 and door panel trim 43 to the side jamb component 29.

Figure 16:
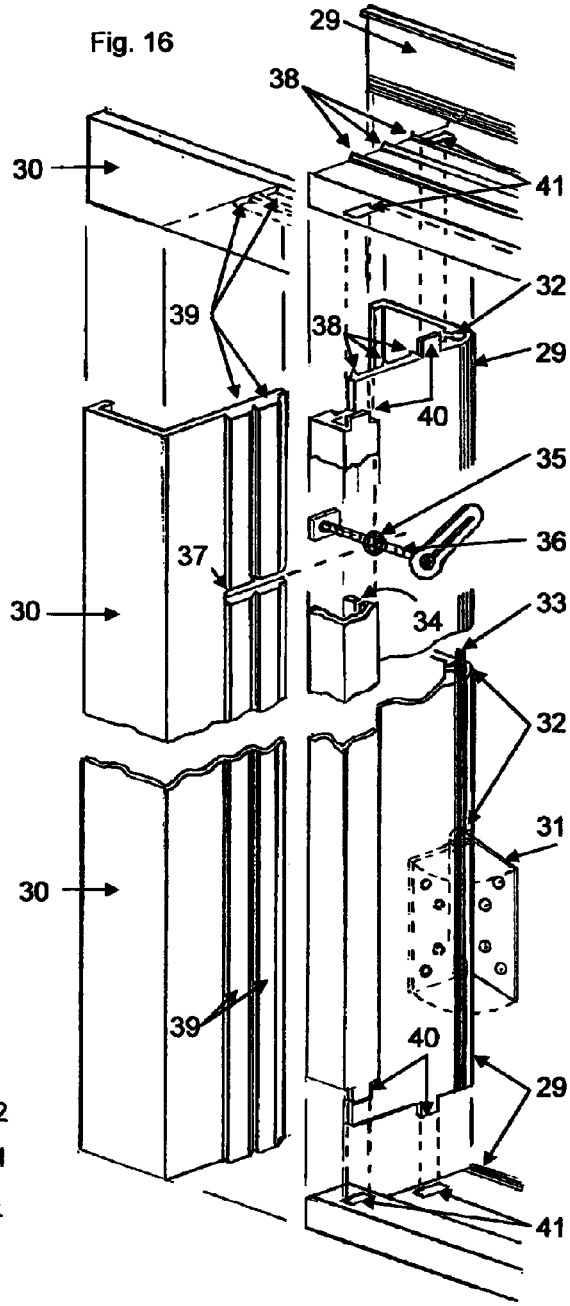
FIG. 16 is a perspective cutaway elevation view of the various door frame components showing their locking and invertible functions and capabilities according to the present invention.

FIG. 16 shows a perspective cut-away elevation of the various door frame components to illustrate more specifically individual component relationships, details, and the reversible and invertible function of the door assembly. Jamb component 29 and separate hinge components 31 each include a round hollow profile 32 on their respective outside edges that allow insertion of a continuous hinge securing rod 33 to attach the two components together. The single hinge-side jamb component 29 includes a series of cut-out sections to allow insertion of hinge components 31 and corresponding vertical alignment of their respective round hollow profiles 32. Side jamb, header and sill components 29 each include an extruded open slot to receive a continuous weatherstrip component 34. Side jamb and header components 29 include a series of holes 35 where a finger-turn locking assembly 36, comprised of a thru-bolt and a non-removable compression nut, is installed. Corresponding side jamb and header components 30 include a series of open-ended slots 37 that align with the series of thru-bolts 36 installed on jamb components 29. Together components 36 and 37 allow for a sliding back and forth motion between jamb components 29 and 30 for adjustability to variable adjacent wall panel thicknesses. Jamb components 29 include a series of protruding 'v' shapes 38 that rest into a corresponding series of reverse retention 'v' shapes 39 that are integral to jamb components 30. Jamb components 29 and 30 are then prevented from sliding apart when tightened together with the bolt and compression nut assembly 36. The two each side jamb components 29 each include on their ends a pair of male tabs 40 that fit into a corresponding pair of female slots 41 that are punched into the top surfaces of the header and sill components 29. The series of tabs 40 and slots 41 prevent potential horizontal movement between the two each side jamb components 29 and the header and sill components 29. The series of tabs 40 and slots 41 also allow the hinge-side jamb component 29 and attached door components 42 and 43 to be inverted between the header and sill components 29 in order to change the door to either a right or left handed swing function. The entire door assembly 28 is also installable on either the exterior or interior of the wall to additionally provide for any of the 4 each possible swing functions required. A structural insulated door panel 42 as seen in FIG. 15 is wrapped on all 4 sides with a 'U' shaped trim cap component 43, and is attached with a series of fasteners 44 to a series of symmetrically centered surface mounted hinge components 31. A commercially available flush mounted latching and locking mechanism is installed in the door panel component 42 to complete the door assembly. Each of the door assembly components can be made from any variety or combination of metals, plastics, composites, fiber reinforced polymers, fiberglass or other types of material.

FIG. 17 shows a perspective cut-away view of the collapsed structure to illustrate details for the conveyance and tie-down strap and hook assembly, the dual-function pad leveler and stacking guide assembly, and the bladder bag assembly. A series of load compliant looped strap carrying handles 45 are attached to the floor curb component 19 for conveyance of the transportable structure 10. Two separate continuing sections of the tie-down strap 46 are interconnected with a commercially available load compliant ratchet-tight buckle 48. The remaining end of the tie-down strap 46 is attached to a commercially available load compliant flat hook 47. Hook 47 connects to the roof-to-wall connector curb 23 for securing the structure 10 while it is in a flat collapsed transportable configuration, or alternately hooks onto either the eyelet 54 that is integral to bladder bag 53, or onto a spiral ground stake 55, for securing the fully erected structure 10 to the ground. The bladder bag 53 is filled with water, earth, sand, gravel, or other material to add hold-down ballast weight to the fully erected structure 10. A series of adjustable leveling pad assemblies are installed inside of the floor-to-wall connector component 19. A load compliant square tube 49 is securely installed in component 19. A load compliant leveling tube adapter 50 is inserted into component 49. A load compliant fast-turn threaded rod 51 of sufficient length is welded to a load compliant leveling foot 52, and is then inserted into the receiving threads of the leveling tube adapter 50. When the structure 10 is in its collapsed transportable configuration the leveling foot pad 52 is in a completely retracted position and alternately provides stacking guidance and transportation containment by sliding into and resting on the top track and curb of a lower structure's roof component 23.

The problems addressed by the foldable transportable shelter 10 are many as can be easily seen by those skilled in this art. The foldable transportable structure 10 greatly enhances the ability and proficiency to deploy moveable structures and reduce transportation costs, by including a well-arranged series of structural panels, hinges and other components, which are connected together in a certain way that allows the structure to be folded down into a collapsed configuration to provide a very compact transportable structure. The foldable transportable structure 10 supports easy and complete assembly in the field, especially in more remote locations, by not requiring the use of power, separate hand tools, or separate loose connectors and fasteners that can be misplaced or lost. The foldable transportable structure 10 saves field time and labor costs by requiring only three to four unskilled persons less than fifteen minutes to fully erect it, and it can also be as easily collapsed and re-deployed to a different location in as little time. The foldable transportable structure 10 is environmentally responsible as all individual components are designed to provide more than just one integrated function, thus substantially reducing raw material quantities, environmental impact and production costs. The flexible design of the foldable transportable structure 10 allows for choice of varying raw materials to meet fluctuating market conditions or any user required specifications. The design of the foldable transportable structure 10 includes a geometric folding pattern, as seen in FIG. 3 that provides folding ability of the structure, and also establishes or allows for: combination of varying panel thicknesses for the floor, wall and roof panels; the guided folding motion and cohesive interaction of each individual structure component; maintaining minimal clearances and continual structural support between all adjacent components during the folding process or transportable configuration. The foldable transportable structure 10 provides additional value to the end user as units can be optionally equipped with an integrated removable wall panel system, as amply seen in FIGS. 11 through 13 to allow for the in-the-field switching of the door or window locations, or to create other clear opening locations for flexible flow-through configurations within multiple combined units. The reversible door assembly, as amply seen in FIGS. 14 through 16 saves raw materials and costs by providing a one-size-fits-all assembly. The foldable transportable structure 10 will find wide use anywhere disaster relief, military, and other civil types of operations are required. Private industry would be employed to manufacture the many units required.

Thus it will be appreciated by those skilled in the art that the present invention is not restricted to the particular preferred embodiments described with reference to the drawings, and that variations may be made therein without departing from the scope of the present invention as defined in the appended claims and equivalents thereof.

What is claimed is:

1. A foldable transportable structure, comprising: a three dimensional structure capable of folding into a compact and stackable configuration for any transportable method; a series of interconnected structural panels and hinges arranged in a way to function structurally in either a collapsed flat or vertical erected position; a series of removable panels for optional creation of openings at various structure locations; a reversible door assembly for ingress and egress of the structure; an operable window assembly for daylight and fresh air flow; a series of adjustable pad levelers to level the structure on uneven ground and alternately guide the placement of stacked collapsed structures; a series of adjustable straps to provide conveyance handles, and secure structural tie-down of the unit in either a collapsed or erected position; a bladder bag capable of being filled with various materials that provides weighted ballast for attaching adjustable straps to secure structural tie-down of the structure;

a series of continuous pivot hinge-to-panel connectors further comprising:

a variety of panel-to-panel connectors of which each is manufactured as one extruded, protruded or combined unified component, and is comprised of two each various shaped panel edge cap shapes with a continuous articulating hinge integrally attached between them, each said connector further including a variety of component dimensions and can be made of a variety of materials such as plastics, mental, resins, composites or other materials;

a separate floor panel-to-curb component of sufficient dimensions to be able to receive a floor panel and a continuous pivot hinge wall-to-wall connector component;

a separate continuous pivot hinge wall-to-wall connector for the attachment of two wall panels together, or a wall to the floor curb component;

a separate roof ridge-to-wall connector component for the attachment of the roof panel to the top panel of the tall wall assembly, inclusive of an integrated built up 5 mm curb leveling pad containment section on the top part of the component, to provide sliding containment for leveling pads of another structure when it is placed on top of said collapsed structure, and alternately provides secure hook capture for the strap tie-down system when the said structure is in its collapsed transportable configuration;

a separate roof eave-to-wall connector component for the attachment of the roof panel to the top panel of the short wall assembly, inclusive of an integrated built up 5 mm curb leveling pad containment section on the top part of the component, to provide sliding containment for leveling pads of another structure when it is placed on top of said collapsed structure, and alternately provides secure hook capture for the strap tie-down system when the said structure is in its collapsed transportable configuration.

2. A foldable transportable structure according to claim 1, wherein said structure includes means for folding the structure to either a collapsed or vertical erected position, within the limits of a geometric folding pattern that guides alignment and placement of interconnected structural panels into a compact flat position when folded down, and into a straight vertical plumb position when folded up, while also allowing flexibility for the use of varying panel thicknesses and/or different combined floor, wall and roof thicknesses.

3. A foldable transportable structure according to claim 1, wherein said hinges are continuous pivot hinge panel-to-panel connectors that provide structure folding ability, structural panel-to-panel connections, and are formed in a way to simultaneously cover raw panel edges and connect opposing panels together with a continuous weatherproof hinge.

4. A foldable transportable structure according to claim 1, wherein said structure includes an interchangeable removable wall panel system where the individual panels are strategically located by a geometric grid pattern that establishes optional locations for door, window and clear openings, and exactly aligns opposing openings of separate structures when connecting multiple structures together.

5. A foldable transportable structure according to claim 1, wherein said structure includes an adjustable any-swing reversible door, frame and threshold assembly, and requires NO tools or separate fasteners, and can be placed in any orientation within any removable panel location, and is not impacted by the use of varying panel thicknesses.

6. A foldable transportable structure according to claim 1, wherein said structure includes an adjustable pad leveling system that provides for leveling the structure, and alternately provides guided sliding alignment and seating placement when placing one collapsed structure on top of another for stacked transportation.

7. A foldable transportable structure according to claim 1, wherein said structure includes a multi-function conveyance and tie-down strap and hook system that provides handles for conveyance, and alternately secure tie down of the structure when it is in either a folded flat transportable or vertically erected configuration.

8. A foldable transportable structure according to claim 1, wherein said structure includes a separate pliable bladder bag component that when filled with a pourable type weighting material, and attached to the tie-down strap and hook system, provides additional secure tie down of the fully erected structure.

9. A foldable transportable structure for human occupation or storage, comprising:

a geometric folding pattern;

at least one continuous pivot hinge-to-panel system;

at least one removable wall panel system;

at least one adjustable reversible any-swing door, frame and threshold assembly;

at least one adjustable dual-function pad leveler and stacking guide system;

at least one attached multi-function conveyance and tie-down strap and hook system;

at least one bladder bag ballast assembly;

wherein said continuous pivot hinge-to-panel connectors further comprising:

a variety of panel-to-panel connectors of which each is manufactured as one extruded, protruded or combined unified component, and is comprised of two each various shaped panel edge cap shapes with a continuous articulating hinge integrally attached between them, each said connector further including a variety of component dimensions and can be made of a variety of materials such as plastics, mental, resins, composites or other materials;

a separate floor panel-to-curb component of sufficient dimensions to be able to receive a floor panel and a continuous pivot hinge wall-to-wall connector component;

a separate continuous pivot hinge wall-to-wall connector for the attachment of two wall panels together, or a wall to the floor curb component;

a separate roof ridge-to-wall connector component for the attachment of the roof panel to the top panel of the tall wall assembly, inclusive of an integrated built up 5 mm curb leveling pad containment section on the top part of the component, to provide sliding containment for leveling pads of another structure when it is placed on top of said collapsed structure, and alternately provides secure hook capture for the strap tie-down system when the said structure is in its collapsed transportable configuration;

a separate roof eave-to-wall connector component for the attachment of the roof panel to the top panel of the short wall assembly, inclusive of an integrated built up 5 mm curb leveling pad containment section on the top part of the component, to provide sliding containment for leveling pads of another structure when it is placed on top of said collapsed structure, and alternately provides secure hook capture for the strap tie-down system when the said structure is in its collapsed transportable configuration.

10. An improved foldable transportable structure according to claim 9 wherein said geometric foldable pattern further comprises:

a geometric foldable pattern for calculating accurate finished panel dimensions for: a floor panel expressed as 'A' with an arbitrarily chosen width dimension being designated as 'X', a bottom short wall panel expressed as 'B' being of a height that is relative to 41.27617% of 'X', an upper short wall panel expressed as 'C' being of a height that is relative to 43.27018% of 'X', a bottom tall wall panel expressed as 'D' being of a height that is relative to 55.63310% of 'X', an upper tall wail panel expressed as 'E' being of a height that is relative to 57.76271% of 'X', a roof panel expressed as 'F' that is of a width that is relative to 103.98803% of 'X', a pair of gable panels expressed as 'G' that are of a width that is relative to 99.70089% of 'X', a pair of gable panels expressed as 'G' with a short point height that is of a length that is relative to 84.24725 of 'X' plus the chosen thickness width of the wall panels, a pair of gable panels expressed as 'G' with a tall point height that is of a length that is relative to 112.96111% of 'X' plus the chosen thickness width of the wall panels.

11. An improved foldable transportable structure according to claim 10 wherein said geometric folding pattern further comprises:

the floor panel expressed as 'A' with an arbitrarily chosen width dimension being designated as 'X', as in claim 8, is in the range of not less than 1800mm (=4.9' headroom low side) and not more than 2070mm, thus limiting the structure's overall finished dimensions to maintain: adequate low side interior head clearance;

adequate gable wall vertical length for installation of an exterior door of sufficient useable height; a collapsed maximum total width for ability to fit into and out of internationally standardized modal transportation openings.

12. An improved foldable transportable structure according to claim 10 wherein said geometric folding pattern further comprises:

a horizontal length limit for the total finished three dimensional structure to he not less than 1200mm, thus limiting the structure's overall finished dimensions.

13. An improved foldable transportable structure according to claim 10 wherein said geometric folding pattern further comprises:

a horizontal length limit of the total finished three dimensional structure to be not less than 1200mm and not more than 5892mm, thus limiting the structure's overall finished dimensions.

14. An improved foldable transportable structure as in claim 9 wherein said structure has a removable pop-out/pop-in wall panel assembly system further comprising:

a strategic grid located series of removable walls panels that match the hinging profile of the tall side wall panels, each said panel further including a special shaped interlocking panel edge cap, a series of pivot hinge-to-panel connectors, an integrated removable window panel section, and an integrated removable bottom curb section.

15. An improved foldable transportable structure as in claim 9 wherein said structure includes an adjustable reversible any-swing door, frame and threshold assembly comprising:

an assembly of separate components that include a jamb, header, threshold sill, door panel, weather-strip, hinges, finger-turn jamb locking mechanism, and an entry locking mechanism of which each can be made of a variety of materials such as plastics, metals, resins, composites or other materials, and that when combined together provide a fully adjustable door assembly that is able to conform to any wall thickness and to any swing configuration desired, without the requirement of separate fasteners or tools for installation.

16. An improved foldable transportable structure as in claim 9 wherein said structure includes a series of adjustable leveling pads also described as a dual-function pad leveler and stacking guide system, that provides adjustment to the level of the structure by a simple turning function of a threaded leveling rod and attached pad component, and alternately provides a mechanism for sliding and containing stacked structures on top of another for shipping, and comprises:

an assembly of separate components that include a hollow tube, leveling tube adapter, threaded rod with attached foot of which each can be made of a variety of materials such as plastics, metals, resins, composites or other materials, and that when combined together provide a fully adjustable structure leveling assembly without the requirement of separate tools for adjustment.

17. An improved foldable transportable structure as in claim 9 wherein said structure includes a series of attached straps with adjusting capabilities also described as a multi-function conveyance and tie-down strap and hook system, that comprises:

at least one each single continuous strap that can be made of a variety of materials such as cotton, silk, nylon, polypropylene, polyester, hemp, polyurethane, Nomex, Kevlar, composites or other materials, and is attached to the structure in a way to simultaneously provide a fixed looped handle configuration for conveyance, and an extending adjustable tie-down strap and hook system for structural tie-down of the structure when it is in either a collapsible or erected configuration.

18. An improved foldable transportable structure as in claim 9 wherein said structure includes a tillable bladder bag, that comprises;

at least one load corn pliant pliable bladder bag that can be made of a variety of materials such as rubber, synthetic rubber, nylon, polypropylene, polyurethane, composites or other materials, and that becomes attached to the tie-down strap and hook system to provide sufficient additional weight to the structural tie-down assembly.

19. An improved foldable transportable structure as in claim 18 wherein said structure includes a tillable bladder bag, that comprises;

At least one load compliant ballast bag that can be either rolled or folded up to fit inside the strategically provided voids within the collapsed structure, and when deployed provides a series of integral eyelets for receiving the hook component of the tie-down strap and hook system and additional spiral earth anchor components if required, and is then filled with a pourable material that can be made of water, sand, gravel, or other material through a top mounted opening with a removable apparatus.

* * * * *